United States Patent [19]

Keegan

[11] 3,935,734

[45] Feb. 3, 1976

[54] PIPETTES

[76] Inventor: William P. Keegan, 155 Beach 133rd St., Belle Harbor, N.Y. 11694

[22] Filed: Feb. 26, 1975

[21] Appl. No.: 552,971

[52] U.S. Cl. ..... 73/425.6

[51] Int. Cl.[2] ..... B01L 3/02

[58] Field of Search ..... 73/425.4 P, 425.6; 222/309

[56] References Cited

UNITED STATES PATENTS 3,834,590 9/1974 Robinson et al. ..... 73/425.6

*Primary Examiner*—S. Clement Swisher

[57] ABSTRACT

A mechanical pipette having a fixed stroke for aspirating and discharging a predetermined volume of liquid into and from a reservoir. A measuring piston controls the volume of liquid drawn into the reservoir and a substantially larger piston assures that all of the liquid in the reservoir is expelled therefrom on a discharge stroke. On the discharge stroke, a mechanically actuated valve is opened to admit air being compressed by the substantially larger piston into the reservoir.

7 Claims, 5 Drawing Figures

PIPETTES

The present invention relates to pipettes, and especially to pipettes having means to assure that the volume of liquid aspirated into a reservoir is entirely discharged from the pipette when the reservoir is emptied. More particularly, the invention relates to a pipette having a first measuring piston that determines the volume of liquid drawn into a reservoir, and a second piston having a diameter substantially larger than that of the measuring piston, which second piston compresses a large volume of air that is directed to the reservoir to assure the expulsion of all the liquid therein.

The utility of many laboratory procedures requires the precise measurement of a small volume of liquid. It is not uncommon to require the accurate dispensing of volumes of less than 10 milliliters. Even for larger volumes, it is desirable that the accuracy of the measurement be assured and that it be repeatable over many pipetting operations. The design of manual pipettes generally assures that a precise predetermined volume of liquid is aspirated into the pipette reservoir, but the discharge of that precise volume is not always achieved. Quite often, a small quantity of the liquid remains after the discharge stroke of the piston is completed. And unless all of the liquid is discharged from the reservoir, the precision built into the pipette mechanism is negated. The liquid remaining may be a droplet formed at the orifice of the pipette tip which is not discharged with the rest of the liquid, or it may be a thin film of liquid adhering to the wall of the reservoir. This often results because the air in the reservoir above the liquid level is a compressible fluid that cannot positively expel all of the liquid when the pipette piston is depressed to expel the liquid. It will be appreciated that the complete discharge of liquids from pipette reservoirs is important in the use of such pipettes for critical laboratory procedures. This is especially true where small volumes, in the order of 10 milliliters or less, are being measured. In such cases, the volume of a droplet remaining on a pipette tip will be an appreciable part of the volume initially aspirated. So much so has this become a consideration that a great deal of inventive effort has been directed towards the provision of pipettes that will expell essentially all of the liquid initially drawn into the pipette.

Thus, in the prior art it has been suggested that the measuring piston of a pipette be given a first stroke, determined by a relatively strong spring stop, for aspirating the desired volume of liquid into the reservoir, and a second longer stroke by overcoming the force of the strong spring to discharge the liquid from the reservoir. See, for example, Pat. No. 3,757,585. Other prior art disclosures provide for a longer discharge stroke of the measuring piston by other means. Pat. No. 3,766,785 provides a first fixed stop for the filling stroke and a second fixed stop for the discharge stroke, but the technician has to rotate the plunger mechanism manually so that either of the stops is selectively made effective in arresting the travel of the plunger and measuring piston. Pat. Nos. 3,766,784 and 3,506,164 disclose indexing mechanisms that render a first and a second stop device alternately effective to arrest movement of a measuring piston thereby obviating the technician's effort to select the stop desired. As in the pipette disclosed in Pat. No. 3,766,785, one stop controls the volume of liquid aspirated into a reservoir while the second stop allows a greater movement of the measuring piston to discharge the liquid. Pat. No. 3,591,056 discloses two plungers, the travel of one being restricted to control the filling stroke of the measuring piston, while the second plunger bypasses the stop for the first plunger and permits an overtravel of the measuring piston. Pat. No. 3,646,817 discloses a pipette having a first measuring piston to control the volume of liquid aspirated into a reservoir telescoped within a larger discharge piston. The first piston is biased by a relatively weak spring and the second piston by a strong spring. A common plunger actuates both pistons. On a filling stroke, the technician depresses the plunger, moving the first piston, until the strong spring is tactilely encountered whereupon the plunger is released and the pipette reservoir filled. To discharge the aspirated liquid, the plunger is depressed past where the strong spring is encountered thereby causing the second larger piston to expel the aspirated liquid. Pat. No. 3,834,590 discloses a pipette having a first measuring piston for drawing the desired volume of liquid into the pipette reservoir and a second piston for compressing air in a separate plenum. The stroke of the measuring piston is limited by a stop that is biased by a relatively strong spring. When the stop is overcome by increased pressure on the driving plunger, the air compressed by the second piston is admitted to the pipette reservoir to aid in expelling liquid therefrom. Co-pending application Ser. No. 441,765 filed Feb. 12, 1974 discloses a pipette having a measuring piston and a second blow out piston having a substantially larger area than the measuring piston. The pistons are actuated by a common plunger mechanism that is arrested by a fixed stop on both the filling and the discharge strokes. Air compressed by the blow out piston is admitted to the pipette reservoir to blow out any liquid therein by a spring biased check valve that is opened by the pressure of the compressed air.

While each of the pipettes disclosed in the prior art operates as intended, each has certain disadvantages or limitations. For example, those pipettes which depend on an overtravel of the measuring piston to discharge liquid from the pipette reservoir obtain a minimal effect towards this end. The reason for this is that a compressible column of air is located between the liquid being discharged and the tip of the measuring piston. The additional overtravel of the piston, which is relatively small, is usually ineffective in dislodging liquid adhering to the reservoir as a droplet or thin film, especially if the column (or volume) of air between the liquid and the piston tip is relatively large compared to the overtravel. Moreover, some of the pipettes resorting to the simple overtravel expedient are mechanically complicated, employing such arrangements as indexing mechanisms and separate filling and discharge plungers. One such pipette requires the technician to rotate the plunger mechanism for alternate strokes thereof. Except fot the co-pending application referred to hereinabove, the pipettes employing a second larger blow out piston to assist in discharging liquid from the pipette reservoir resort to a spring biased stop for determining the filling stroke of the measuring piston. Since the stop is not fixed, even the slightest compression of the spring biasing the stop during a filling stroke leads to an inaccurate volume of liquid being drawn into the pipette reservoir thereby vitiating the precision with which the pipette is manufactured. In co-pending application Ser. No. 441,765, the limitations of the prior art just mentioned have been overcome by the disclosure of a pipette wherein the plunger is arrested by the same fixed stop on both the filling and the discharging strokes. There is no necessity for the technician to sense tactilely a resilient stop in order to end a filling stroke. Rather, the plunger is depressed until a fixed stop is encountered, and the plunger cannot be depressed farther, whereupon the plunger is released with the assurance that the volume of liquid predetermined by the precision manufacture of the pipette will be drawn into the pipette reservoir. The pipette of the co-pending application, however, does impose manufacturing tolerances on the pipette since the spring that biases the check valve to a closed position must be extremely light and fall within close tolerances from spring to spring so as to be sensitive to the pressure built up by the blow out piston, and yet the valve mechanism must be freely operable so as to function properly during each stroke of the pipette plunger.

It, therefore, is the object of the present invention to provide an improved pipette which assures the complete discharge of all the liquid aspirated into the pipette reservoir.

It is another object of the invention to provide a pipette having a fixed stroke in which more air is expelled from the pipette during a discharge stroke than is aspirated by the measuring piston during a filling stroke.

It is still another object of the invention to provide a pipette in which both the filling and the discharge strokes are determined by the same fixed stop and in which air compressed by a blow out piston substantially larger than a measuring piston is admitted to the pipette reservoir by a valve that is mechanically actuated just before termination of the discharge stroke.

In carrying out the invention, there is provided a pipette having a fixed plunger stroke for both filling and discharging the pipette. The filling stroke aspirates a predetermined volume of liquid into the pipette reservoir by moving a measuring piston between two limiting positions in a small volume air chamber. The volume of liquid aspirated depends on the area and the measuring stroke of the piston. The discharge stroke provides, in addition to the air trapped in the small volume air chamber, a large quantity of air from a second air chamber which assists in blowing the aspirated liquid from the pipette reservoir. The second air chamber is separated from the small volume air chamber by mechanically actuated valve means which close the fluid passageway between the two air chambers during a filling stroke, and which open the fluid passageway during a discharge stroke so that a piston moving in the second air chamber can move air from the second air chamber to the small volume air chamber.

Features and advantages of the invention may be gained from the foregoing and from the following description of a preferred embodiment of the invention.

DETAILED DESCRIPTION OF THE INVENTION

Figure 1:
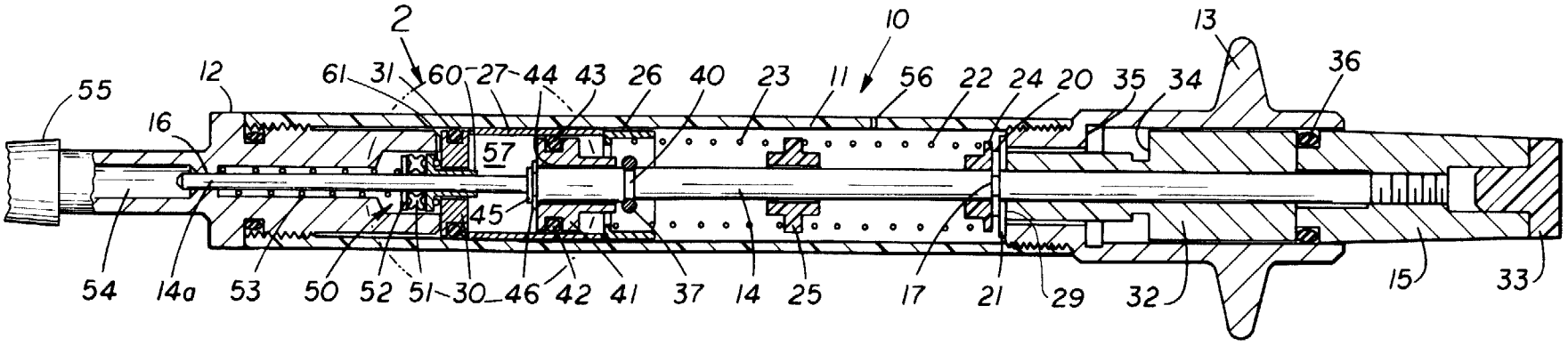
FIG. 1 is a side elevational view, in section, of a pipette embodying the present invention.

Reference is now made to FIG. 1 which illustrates one embodiment of the invention. The pipette 10 comprises basically a tubular barrel 11, the forward or bottom end of which is internally threaded to accommodate a nozzle member 12. The opposite end of barrel 11 also is internally threaded so that a terminal member 13, which is externally threaded as shown, can be connected securely to the barrel. A piston rod 14 is shown with a measuring piston **14*a* formed at its forward end. Displacement of rod 14 and piston 14*a* causes the drawing of the liquid being pipetted into the nozzle or preferably into a disposable tip press fitted onto the nozzle. At its other end, rod 14 is shown extending to a plunger knob 15 slideably positioned at the extreme end of terminal member 13. In broad principal, depression of knob 15, rod 14, and piston 14*a* (i.e., movement thereof to the left in the drawing) expels a quantity of air from nozzle member 12 so that when the knob 15** is returned to its normal position, as by a biasing spring as will be described hereinafter, a like quantity of liquid, into which the nozzle member or disposable tip is inserted, will be aspirated into the nozzle member or tip. A disposable tip is preferably used so that it is inserted into the liquid and the liquid is drawn up into the tip only. In this way the pipette itself is never touched by the liquid, and thus can never be contaminated thereby or cause cross-contamination when different samples, especially of biological fluids, are being pipetted.

At its forward end piston 14a is guided in nozzle member 12 by the annular guide ring 16 formed internally in member 12 during its manufacture. The guide ring does not form an air tight seal around piston **14*a***, but rather permits air to pass freely between it and the piston. The reason for this will be made clear hereinafter.

Towards its other end where it initially passes through member 13, rod 14 is provided with a groove 17 into which fits a snap washer 20. A bearing washer 21 is placed between snap washer 20 and the end surface of member 13, which surface forms a fixed stop that establishes one extreme of travel of rod 14 and piston 14a. Spring means, comprising compression springs 22 and 23, bias rod 14 and piston **14*a* to the position illustrated which is determined by the location of groove 17 and washer 20 along rod 14. While one spring could have been used instead of the two shown, the latter arrangement is preferred since a single spring would have a tendency to bow when being compressed and rub against the barrel 11 or rod 14 to cause a squeaking sound. Springs 22 and 23 bear against nylon bushings 24 and 25, which fit loosely over rod 14, and against a flanged cylinder 26. The cylinder in turn bears against tube 27 and the tube against the circumferentially grooved disk 30. An "O" ring 31 is mounted in the groove of disk 30, the disk itself being provided with a central aperture through which rod 14 passes with ample clearance. It will be apparent that disk 30, tube 27, and cylinder 26 can simply be slipped into barrel 11 since they all are held snugly in position abutting one another and the end of nozzle member 12 by the action of springs 22 and 23**.

Within member 13, rod 14 passes through a metering block 32 which is restrained against lengthwise travel along rod 14 by its engagement with washer 21 and knob 15, the latter of which is threaded or force fitted on rod 14 until block 32 is moved into abutting relationship with washer 21. A button 33 is pressed into the end of knob 15 to give it a finished appearance. The button *m* may be of a plastic material and color coded to indicate the volumetric capacity of the pipette. Along this line, barrel 11 may also be of a plastic material and color coded for the same purpose. Also, an O-ring 36 serves as a low friction bearing member guiding knob 15 along the internal diameter of member 13. The O-ring is not intended to provide an air tight seal, and it does not.

It will be clear from the description so far that the rod 14 will be in the one limiting position illustrated by the action of springs 22 and 23. When the rod is depressed, as by pressure on knob 15 the rod will move until the end 34 of the wider diameter portion of block 32 strikes the shoulder 35 formed on the inside of member 13. Thus the volumetric capacity of the pipette will be determined by the cross sectional area of measuring piston 14*a* and the length of the stroke of the piston. The latter, of course, is determined by the abutment of the end 34 of block 32 with shoulder 35, and the engagement of snap washer 20 and bearing washer 21 with the inside end 29 of member 13. As will be explained hereinafter, due to the construction of the present pipette, the effective aspirating stroke of rod 14 will be slightly less than that just indicated. But, since the difference between the total stroke and the effective stroke will be known and fixed, compensation can be made so that the pipette aspirates the exact predetermined volume of liquid. To vary the capacity of the pipette, a different block (not shown) would be used, the different block having the same overall length as block 32 but having a wider diameter portion of shorter or longer length. In this way a different length stroke would be provided. Or alternatively, the position of groove 17 and washer 20 could be changed.

Attention is now directed to those components of the pipette which assure that all of the liquid aspirated into the pipette reservoir will be expelled during a discharge operation. A sealing ring 37 is positioned in annular groove 40 formed on the circumference of rod 14. Spaced a short distance along rod 14 from ring 37 is the overblow piston 41. This piston 41 is formed with an annular groove 42 which receives an O-ring 43 that provides an air tight seal as piston 41 slides along tube 27. Overblow piston 41 is provided with an axial bore 44 through which rod 14 can slide with sufficient clearance to allow air to flow from one end of piston 41 to the other. A snap ring washer 45 on rod 14 and washer 46 bear against overblow piston 41 and move it to the right (as viewed in the drawing) to the position shown. It will be observed that piston 41 moves longitudinally relative to rod 14 between positions determined by snap washer 45 and seal ring 37. The reason for this will become clear as the description progresses.

A valve 50 in the form of a quad ring 51, washer 52, compression spring 53, flanged hollow tube 60, and sealing ring 61 is provided between piston 14a and disk 30. Spring 53 is a relatively light spring the only purpose of which is to cause quad ring 51 and sealing ring 61 to make an air tight seal between piston 14a and disk 30. However, the spring is weak enough to permit very little axial force on tube 60 to compress it and thus open valve 50 and allow air from chamber 57 to flow down around piston 14a and out nozzle member 12.

Having thus described the construction of the pipette, its operation will now be considered. Pipette 10 is generally grasped by a technician with his four fingers surrounding barrel 11 and his thumb resting on knob 15. It is, of course, immaterial how the pipette is grasped, and any way comfortable and convenient to the technician will suffice. Knob 15 is depressed until end 34 of block 32 strikes shoulder 35 thus driving piston 14a down into chamber 54 to supplant a predetermined volume of air. The tip of the pipette 10 or preferably a disposable tip 55 mounted on nozzle member 12 is then inserted into the liquid being pipetted. Thumb pressure is released from knob 15 whereupon springs 22 and 23 move rod 14 to the right (as shown in the drawing) until washer 21 strikes the end of member 13. As piston 14a moves to the right liquid is aspirated into the pipette tip 55. At the end of its rightward travel, the parts of the pipette will be as illustrated and a predetermined volume of liquid will be in pipette tip 55.

The interior of the pipette to the right of disk 30 will contain air at atmospheric pressure since that portion of the pipette to the right of O-ring 31 and valve 50 is not of air tight construction. In fact, a small aperture 56 could be provided in barrel 11 to assure that air does leak into the interior of the pipette. Note especially that piston 41 is spaced from seal ring 37 so that air will leak past ring 37 and through bore 44 of piston 41 to the air chamber 57 between disk 30 and piston 41. Note also that valve 50 prevents any air leakage around piston 14a.

To discharge the liquid from pipette tip 55, knob 15 is again depressed. Initially, overblow piston 41 does not move because of its free fit on rod 14 and because of the snug air tight engagement with the internal wall of tube 27 provided by O-ring 43. During this initial relative movement between rod 14 and overblow piston 41, washer 45 moves away from the left hand end of piston 41. However, as rod continues its movement to the left, seal ring 37 engages the right hand end of piston 41 and thereafter, overblow piston 41 will move along with rod 14. Chamber 57 is now sealed, and air pressure therein builds up as the volume of the chamber is decreased by the leftward movement of piston 41. At a position in the leftward movement of rod 14, just prior to such movement being arrested by the engagement of end 34 of block 32 with shoulder 35, washer 45 engages the end of tube 60 so that additional movement of rod 14 opens valve 50 and allows the compressed air in chamber 57 to expand into chamber 54 and expel the liquid in tip 55.

After rod 14 reaches its terminal position as determined by the engagement of member 32 with shoulder 35, thumb pressure is removed from knob 15 and springs 22 and 23 return rod 14 to its other limiting position. During the initial rightward movement of rod 14 valve 50 will be open, and it will not close until rod 14 moves a distance equal to that which tube 60 was translated during the leftward travel of rod 14. It is this incremental distance, which is very small since valve 50 only has to be opened a crack to allow the compressed air in chamber 57 to pass into chamber 54, that rod 14 must travel prior to the closing of valve 50 which must be compensated for in establishing the effective aspirating stroke of rod 14. In other words, the effective aspirating stroke of rod 14 is equal to the stroke as determined by the stops of member 13, i.e., end 29 and shoulder 35, less the distance which tube 60 is translated at the terminal end of a leftward stroke. Also during the initial movement of rod 14 towards its position as shown in the drawing, overblow piston 41 does not move since it must first be engaged by washers 45 and 46 which, at the end of a leftward stroke, are separated from the piston. During the relative movement between rod 14 and piston 41 which brings washer 46 into engagement with piston 41, seal ring 37 is moving away from the opposite end of piston 41 to the relative position shown in the drawing. Rod 14 and piston 41 continue their rightward movement in unison until such time as washer 21 engages the end of member 13. The pipette is then the condition shown in the drawing and ready for further use.

The effectiveness of the present invention may be summed up in general terms as follows. The volume of liquid drawn into the pipette reservoir, i.e., disposable tip 55, is controlled by the displacement of a predetermined volume of air. That is, by the volume represented by the area and effective stroke of measuring piston 14*a*, whereas the expulsion of the liquid from the pipette reservoir is effected by by the displacement of a comparatively large volume of air, i.e., the volume determined by the area and stroke of overblow piston 41. The foregoing result is achieved even though the rod 14 travels between two fixed terminals and travels the same distance on both the filling and the discharge strokes.

Figure 2:
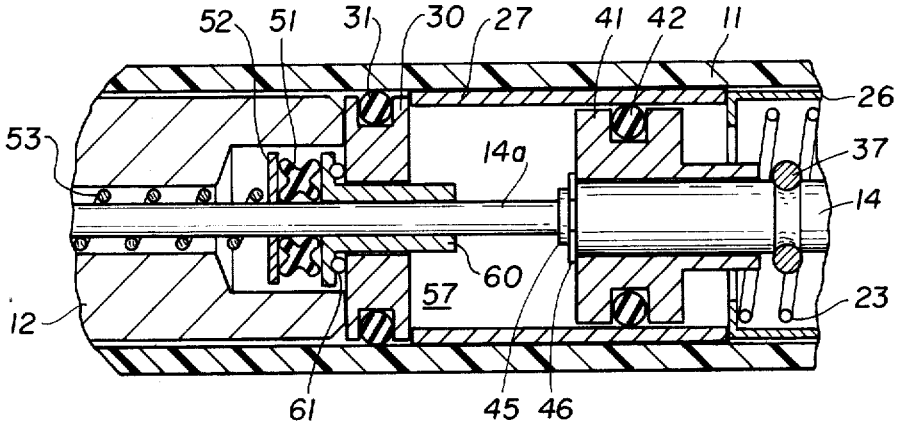
FIG. 2 is a fragmentary sectional view, in enlarged detail, showing that portion of the pipette of FIG. 1 encircled by the dot dash circle numbered 2.
Figure 3:
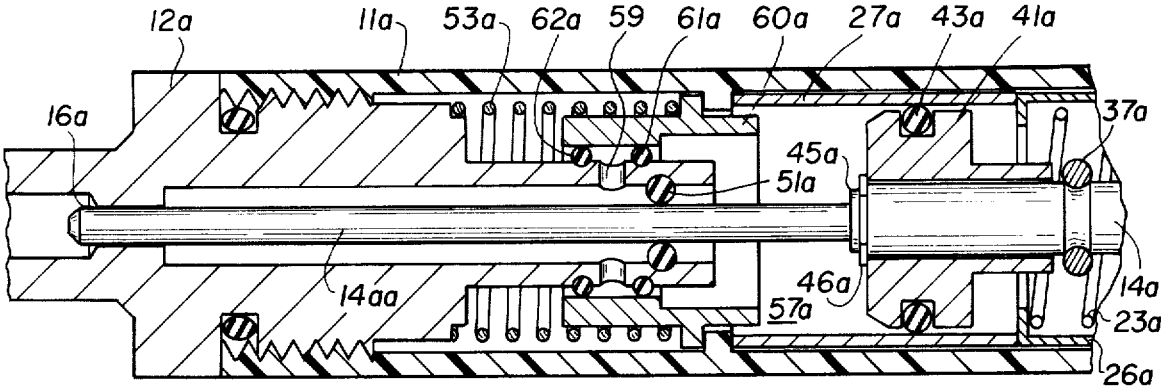
FIG. 3 is a fragmentary view similar to FIG. 2 but showing another embodiment of the invention.

FIG. 3, which is a view similar to FIG. 2, shows a different construction of the valve mechanism which controls the admission of air from chamber 57 to the air chamber 54. In all other particulars the construction of the pipette is the same as in the FIGS. 1 and 2 embodiment. In FIG. 3, components which are similar to or the same as components in the FIG. 1 embodiment have been given the same reference character with the letter *a* appended thereto. Since many of the components are the same as those previously described and function in the same manner, the present description will only be concerned with the different construction.

Nozzle member 12*a* is provided with rightwardly projecting hollow cylindrical portion through which measuring piston 14*aa* extends. A pair, or more, of radical apertures 59 are provided near the remote end of the cylindrical portion. An O-ring 51*a* provides an air tight seal for measuring piston 14aa and O-rings 61*a* and 62*a* provide an air tight seal between sliding valve member 60*a* and the apertured segment of nozzle member 12*a*. A spring 53*a* maintains valve member 60*a* in the position shown against the internal abutment ring provided in barrel 11*a*. The pipette functions similarly to the FIG. 1 embodiment except that, now, at the end of a discharge stroke piston 41a moves into contact with valve member 60*a* to push it leftwardly against the bias of spring 53*a*, thereby allowing air from chamber 57*a* to pass through aperture 59 into the interior of nozzle member 12*a* to blow out liquid in the tip of the pipette. Upon restoration of rod 14*a'* to its normal spring biased position, spring 53*a* restores valve member 60*a* to its normal position as shown in the drawing.

Figure 4:
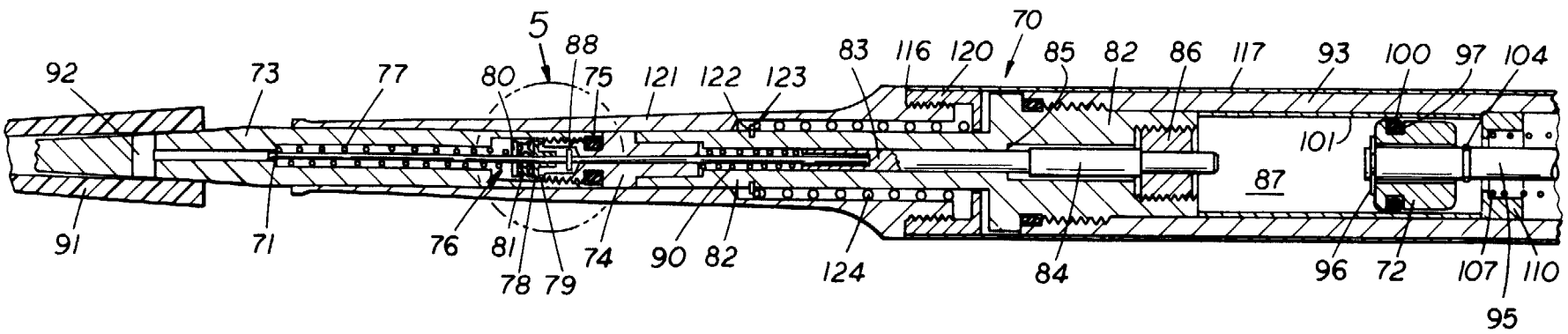
FIG. 4 is a partial side elevational view, in section, of a small volume pipette embodying the present invention.
Figure 5:
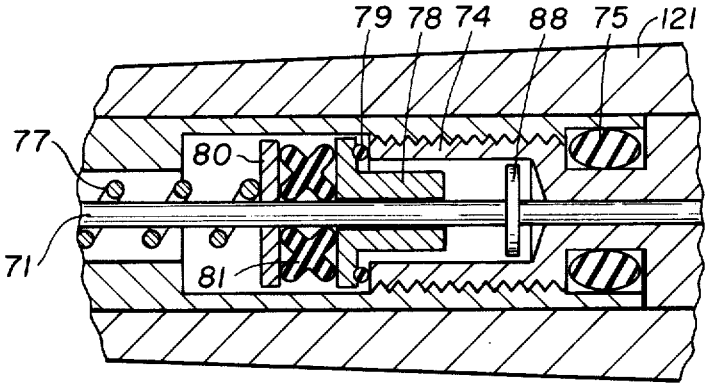
FIG. 5 is a fragmentary sectional view, in enlarged detail, showing that portion of the pipette of FIG. 4 encircled by the dot dash circle numbered 5.

Attention is now directed to FIGS. 4 and 5 which show a different embodiment of the invention which is particularly useful for extremely small volume pipettes; for example, pipettes having a delivery of ten micro liters or less.

The pipette 70 is shown comprising two separate pistons as in the previous embodiment, a measuring piston 71 and an overblow piston 72. Now, however, the pistons are carried on separate plungers for a reason that will become clear as the description progresses. The distal end of piston 71 is fitted within the narrow bore of nozzle member 73 and guided within the central aperture of connecting member 74 which is threaded into nozzle member 73. A seal 75 assures that the joint is air tight. A valve 76 comprising a compression spring 77, a washer 80, a quad ring 81, a flanged hollow rivet like member 78, and a sealing ring 79 is provided for a purpose later described. For the present, it will suffice to say that quad ring 81 and sealing ring 79 provide an air tight seal between piston 71 and member 74. The opposite end of member 74 is brazed into the piston stroke controlling member 82. Member 82 is provided with a central aperture which is stepped to provide three different diameter bores. The smallest bore, which is of a diameter greater than that of the aperture in member 74 carries plunger rod 83 into which measuring piston 71 is press fitted. Further on, the aperture diameter is increased to accommodate the wider diameter portion 84 of plunger 83, a stop shoulder 85 being formed at the point the aperture diameter changes. The plunger 83, after being reduced to its original diameter next passes through an adjusting nut 86 which is threaded into member 82 and projects into chamber 87. A compression spring 90 placed between the ends of members 74 and 83 urges plunger 83, and piston 71, to an initial position determined by the engagement of the end of plunger portion 84 with the face of adjusting nut 86. By turning nut 86 in member 82, the initial position of plunger 83 can be controlled and calibrated. The other terminal position of plunger 83 is determined by the engagement of the other end of plunger portion 84 with stop shoulder 85. Since this position is fixed, it is apparent that the stroke of plunger 83, and piston 71, is determined by the adjusted position of nut 86. Consequently, the volume capacity of pipette 70 is determined by the stroke of measuring piston 71 and its cross sectional area.

Since the presently described pipette is intended for minute volumes, i.e., from 1 to 10 micro liters, the diameter and stroke of piston 71, and the bore in nozzle member 73, are equally minute. The distal end of nozzle member 73 can be likened to an insert plug to be placed in pipette tip 91. Thus, member 73 terminates in a solid cone, and the bore of the member extends only as far as transverse aperture 92. The reason for such an arrangement is to minimize the air volume ahead of the tip of piston 71.

A pipette barrel 93 is internally threaded at one end for connection to member 82 and at its other end for connection to terminal member 94. Within barrel 93, overblow piston 72 is slideably positioned at the end of plunger 95 and is restrained thereon by a washer 96 snapped into a groove formed on plunger 95. Piston 72 is provided with an annular groove 97 which accommodates an O-ring 100 that makes an air tight seal with the inner surface of tubular member 101. A seal ring 104 is mounted in an annular groove on plunger 95 a short distance from the end of piston 72. Further along plunger 95, i.e., to the right in the drawing, the construction of the pipette is similar to that shown in FIG. 1, and so will not be described in detail.

Inasmuch as many pipettes, especially those used for biological purposes, are provided with disposable tips so that pipetted liquids never enter the pipette itself, the pipette illustrated with the present embodiment of the invention is also shown with a tip removal mechanism. It is to be understood, however, that such mechanism need not be provided on the pipette. It should also be understood that such tip removal mechanism could be provided on the pipette illustrated in FIG. 1.

The tip removal mechanism 116 comprises a sleeve member 117 that is slideably positioned over barrel 93. An internally threaded flanged cylinder 120 is brazed or otherwise secured to the inside of sleeve member 117, and into it is threaded the tip removing member 121. A snap washer 122 fitted into a groove on the external surface of member 82 together with washer 123 serves as a seat for compression spring 124. The spring urges the tip removal mechanism 116 to the right (as viewed in the drawing) until sleeve member 117 strikes the lip of terminal member 94. The engagement of the flange of cylinder 120 with member 82 could, in the alternative, serve as the stop for mechanism 116.

In operation, the pipette 70 is grasped in the palm of the hand with four fingers around sleeve member 116 and the thumb on a knob (not shown). A disposable tip 91 is placed on nozzle member 73. The pipette knob is depressed by thumb pressure driving plunger 95 downwardly until its end strikes the end of plunger 83 and drives plunger 83 downwardly until the end of portion 84 strikes shoulder 85 and arrests the movement of both plungers 83 and 95. Thus, piston 71 is driven a distance determined by the movement of portion 84 between the face of adjusting nut 86 and shoulder 85. The pipette tip is then inserted into the liquid to be pipetted. When thumb pressure is released, both plungers return to the positions shown in the drawing, plunger 83 being urged by spring 90, and plunger 95 by spring 107. When plunger 83 returns to its spring biased position, a volume of liquid is aspirated into the pipette tip commensurate with the stroke and area of piston 71.

The air in chamber 87 will be at atmospheric pressure since the pipette to the right of the chamber is not air tight, and air can seep past piston 72 in view of the clearance between plunger 95 and the piston. To assure that air does leak into the interior of the pipette, a small aperture may be provided in the wall of barrel 93, but in general it will not be necessary.

Now, when the pipette knob is depressed to expel the liquid from pipette tip 91, the initial movement of plunger 95 moves seal ring 104 into engagement with the end of piston 72, thus closing off chamber 87 from the interior of the pipette and atmospheric air. Consequently, as plunger 95 continues to the left accompanied by piston 72 driven by seal ring 104, the air trapped in chamber 87 is compressed and its pressure builds up. As plunger 95 continues its travel it engages plunger 83 to move piston 71 to its left. Just prior to termination of the stroke of piston 71 as previously described, snap washer 88, fixedly placed on piston 71, engages rivet like member 78 to open valve means 76 and release the air from chamber 87 through nozzle member 73 to expel the liquid from tip 91. When thumb pressure is released, spring 90 returns plunger 83 to its normal position, as shown, and spring 107 returns plunger 95 to its normal position. Since seal ring 104 moves away from piston 72, chamber 87 is again in communication with the interior of the pipette and atmospheric pressure.

To remove the pipette tip 91, the technician, without removing his finger grip around sleeve 117, places his thumb under the projecting rim or arm of a member similar to 13 in FIG. 1 and moves his thumb upwardly. This action moves the entire pipette, including nozzle member 73 on which tip 91 is mounted, to the right while the tip removal mechanism remains stationary. Thus, the end of tip 91 is brought into contact with the end of member 121 and pushed off nozzle member 73 by continued upward movement of the pipette proper.

Having thus described the invention, it is clear that many apparently widely different embodiments thereof could be provided without departing from its spirit and scope. Many different constructions could be made in the internal configuration of parts or certain features could be omitted while retaining the general principle of operation. Also, the pipette could be configured so that by depressing the thumb knob, liquid is aspirated into the pipette or tip, and by releasing the knob the liquid is expelled. Of course, whether or not a disposable tip is used is optional with the user, and will generally depend on the use to which the pipette is put. A valve of different configuration could be used in place of valve 50. The invention could also be used in automatic or power actuated pipettes in which the pistons are moved by power driven cams, or the like, rather than in manual pipettes as described. Therefore, it is intended that the specification and the drawing be interpreted as illustrative rather than in a limiting sense.

What is claimed is:

1. A pipette comprising, means forming a first air chamber and a second air chamber, measuring piston means movable a predetermined distance in said first air chamber between a first limiting position and a second limiting position, second piston means movable in said second air chamber, said second piston means having a cross sectional area substantially greater than that of said measuring piston menas, valve means separating said air chambers so that said measuring piston means displaces air from said first air chamber while said second piston means compresses air in said second air chamber, actuating means for moving said measuring piston means and said second piston means, first fixed stop means for arresting said measuring piston means in its first limiting position, second fixed stop means for arresting said measuring piston means in its second limiting position, and means for actuating said valve means when said measuring piston means is immediately adjacent its first limiting position, whereby air compressed by said second piston means in said second air chamber is admitted to said first air chamber.

2. A pipette according to claim 1 wherein said actuating means for moving said measuring and said second piston means include a common plunger means on which said measuring piston means and said second piston means are mounted for reciprocating movement, and wherein said fixed stops limit movement of said plunger means.

3. A pipette according to claim 2 including spring means for biasing said plunger means to one limiting position.

4. A pipette according to claim 3 including a fluid passageway extending from said second air chamber to the exterior of the pipette, and means for sealing said passageway during the initial movement of said plunger means away from its spring biased position.

5. A pipette according to claim 1 wherein said measuring piston means is guided for movement between its limiting positions, spring means for biasing said measuring piston means to one of its limiting positions, and wherein said actuating means engages said measuring piston means at an intermediate position in its travel and, thereafter, said actuating means moves in abutting relationship with said measuring piston means to a position determined by said first fixed stop means.

6. A pipette according to claim 1 wherein said valve means comprises sealing means, spring means for biasing said sealing means to a position wherein there is no air passageway between said first and said second air chambers, and a member adapted to be engaged by said actuating means prior to said measuring piston reaching its first limiting position.

7. A pipette according to claim 1 including sealing means for providing an air tight seal where said measuring piston enters said first air chamber, an air passageway between said first and said second air chambers, and wherein said valve means include a sliding member adapted to close said air passageway, and spring means for biasing said sliding member to a passageway closing position.

* * * * *